United States Patent [19]

Hennessey

[11] Patent Number: 4,504,713

[45] Date of Patent: Mar. 12, 1985

[54] PUSH BUTTON ELECTRICAL SWITCH ASSEMBLY

[75] Inventor: Thomas M. Hennessey, Kenosha, Wis.

[73] Assignee: Adams Elevator Equipment Company, Skokie, Ill.

[21] Appl. No.: 513,509

[22] Filed: Jul. 13, 1983

[51] Int. Cl.[3] ..... H01H 1/24

[52] U.S. Cl. ..... 200/241; 200/243; 200/245; 200/250; 200/314

[58] Field of Search ..... 200/241-243, 200/245, 250, 340, 314

[56] References Cited

U.S. PATENT DOCUMENTS

| | | | |
|---|---|---|---|
| 2,439,747 | 4/1948 | Nelson | 200/250 |
| 2,660,629 | 11/1953 | Lucas | 200/243 |
| 2,756,291 | 7/1956 | Peter | 200/16 |
| 2,794,879 | 6/1957 | Clason | 200/243 |
| 3,155,790 | 11/1964 | Lemonnier | 200/243 |
| 3,253,092 | 5/1966 | Landow | 200/16 |
| 3,437,773 | 4/1969 | Koertge | 200/280 |
| 3,529,109 | 9/1970 | Cross | 200/245 |
| 3,639,745 | 2/1972 | Shiki | 200/314 |
| 3,681,552 | 8/1972 | Bailey | 200/314 |
| 3,773,999 | 11/1973 | Groezinger | 200/314 |
| 3,805,004 | 4/1974 | Kondo et al. | 200/314 |
| 3,855,558 | 12/1974 | Hayward | 200/303 |
| 3,988,557 | 10/1976 | Francke et al. | 200/314 |
| 4,006,322 | 2/1977 | Gallatin et al. | 200/243 |
| 4,052,580 | 10/1977 | Stanish | 200/159 R |
| 4,080,523 | 3/1978 | de Loisy | 200/314 |
| 4,126,774 | 11/1978 | Gossling | 200/314 |
| 4,282,414 | 8/1981 | Johnston et al. | 200/340 |
| 4,315,123 | 2/1982 | Fujita et al. | 200/307 |

FOREIGN PATENT DOCUMENTS

| | | | |
|---|---|---|---|
| 583038 | 10/1958 | Italy | 200/243 |
| 305019 | 10/1968 | Sweden | 200/314 |
| 969841 | 9/1964 | United Kingdom | 200/243 |

*Primary Examiner*—John W. Shepperd
*Assistant Examiner*—Renee S. Kidorf
*Attorney, Agent, or Firm*—D. R. Lackey

[57] ABSTRACT

A push button electrical switch assembly including an actuator biased for resilient reciprocation between predetermined axial limits within a housing. A cover on the housing includes a push button movable between predetermined axial limits. The push button contacts and is biased by the actuator to one of its predetermined axial limits. First electrical contacts are fixed to the housing, and second electrical contacts are carried by the actuator. The second electrical contacts, when urged to a contact-engaging position with the first electrical contacts, pivot against the same bias which biases the actuator, to provide a contact-wiping engagement with the first electrical contacts.

7 Claims, 17 Drawing Figures

PUSH BUTTON ELECTRICAL SWITCH ASSEMBLY

BACKGROUND OF THE INVENTION

1. Field of the Invention

The invention relates in general to push button electrical switch assemblies, and more specifically to electrically and mechanically reliable push button and electrical switch assemblies which include contact wiping engagement of their contact elements.

2. Description of the Prior Art

Certain applications for push buttons are more severe than others, such as those used as elevator car call buttons in an elevator car, and elevator hall call buttons in the hallways of a building. These push buttons are subjected to constant usage by the public, and thus they must be built to withstand intense service. They are also subjected to considerable abuse, both intentional and unintentional. Thus, they must be constructed such that they do not invite vandalism, such as by eliminating visible fastening devices. Further, they must be constructed such that they will withstand abuse and vandalism, such as being able to withstand actuation by an umbrella point, and extreme closing pressures, without external or internal damage.

Elevator push buttons have still additional requirements which set them apart from the average push button use. They must notify the user that a call has been entered by illuminating a predetermined portion of the push button after actuation, and the illumination must be maintaned until the call is answered.

In addition to reducing the number of service calls by constructing the push buttons to withstand high usage, abuse and vandalism, they should be constructed to be easily and quickly serviced, when service is necessary. For example, the light source in the push button, or any other elements thereof, must be easily and quickly replaceable by authorized personnel without the necessity of using special tools.

In addition to being mechanically reliable, elevator push buttons must be electrically reliable. Elevator systems are currently being constructed with low voltage, solid-state devices. Thus, the elevator push button should be able to make good electrical contact between its contact elements, when used with low DC logic level voltages and currents, and of course it should be equally suitable and adequately electrically insulated for use with higher AC and DC voltages.

While the above requirements place stringent demands on the structure and design of elevator push button electric switch assemblies, these requirements must be met with an assembly which is economically attractive, i.e., it must be easily manufactured of low cost components, and it must be susceptible to quick and accurate assembly without requiring special skills or exacting labor.

SUMMARY OF THE INVENTION

Briefly, the present invention is a new and improved push button electrical switch assembly constructed or rugged, easily assembled and disassembled subassemblies. The subassemblies include a housing module having fixed electrical contacts, a contact carrier module having an actuator which carries rigid, movable, bridging contacts, a cover module having a halo and push button movable between predetermined axial limits therein, and a lamp module.

The contact carrier module is mounted within the housing module for resilient reciprocative motion between predetermined axial limits by a pair of tongue and groove arrangements and four helical compression springs. The cover module is mounted on the housing module, with the push button in contact with, and biased by the actuator element of the contact carrier module. Pressure on the push button, regardless of where it is applied on its surface, is translated to rectilinear movement of the contact carrier module via the tongue and groove arrangements. Excess pressure on the push button is simultaneously and uniformly distributed between the push button and halo, and between the actuator of the contact carrier module and the housing module.

Electrical reliability is assured by constructing both the fixed and the bridging contacts of silver alloy clad copper elements, and by biasing the bridging contacts to a first position via the same compression springs which bias the contact carrier subassembly. Engagement of a bridging contact with fixed electrical contacts of the housing module pivots or rocks the bridging contact against the bias of the compression springs, to a second position. The rocking or pivotal movement of the bridging contact provides a wiping action of the bridging contact surfaces over the surfaces of the fixed contacts. This wiping action keeps the mating surfaces free of oxidation and dirt, assuring 100 percent electrical contact, even in low voltage, low current circuits, under the most adverse conditions.

The lamp module merely plugs into the rear of the housing module, free of any electrical wires, making contact between the strip terminals of the lamp and resilient contact fingers within the housing module.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
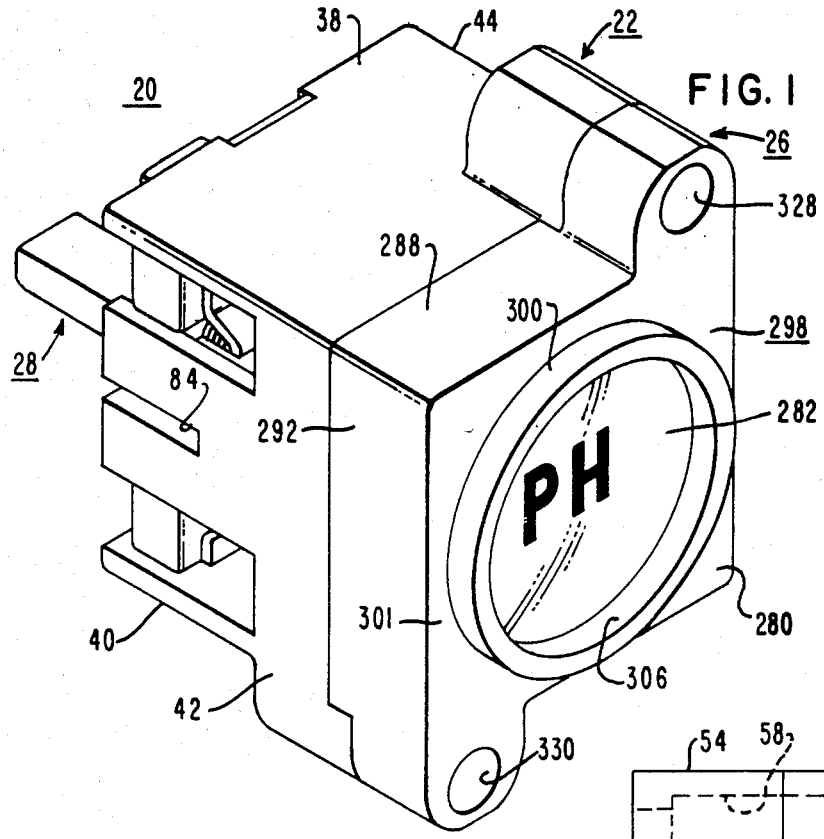
FIG. 1 is a perspective view of a push button electrical switch assembly which is constructed according to the teachings of the invention.
Figure 2:
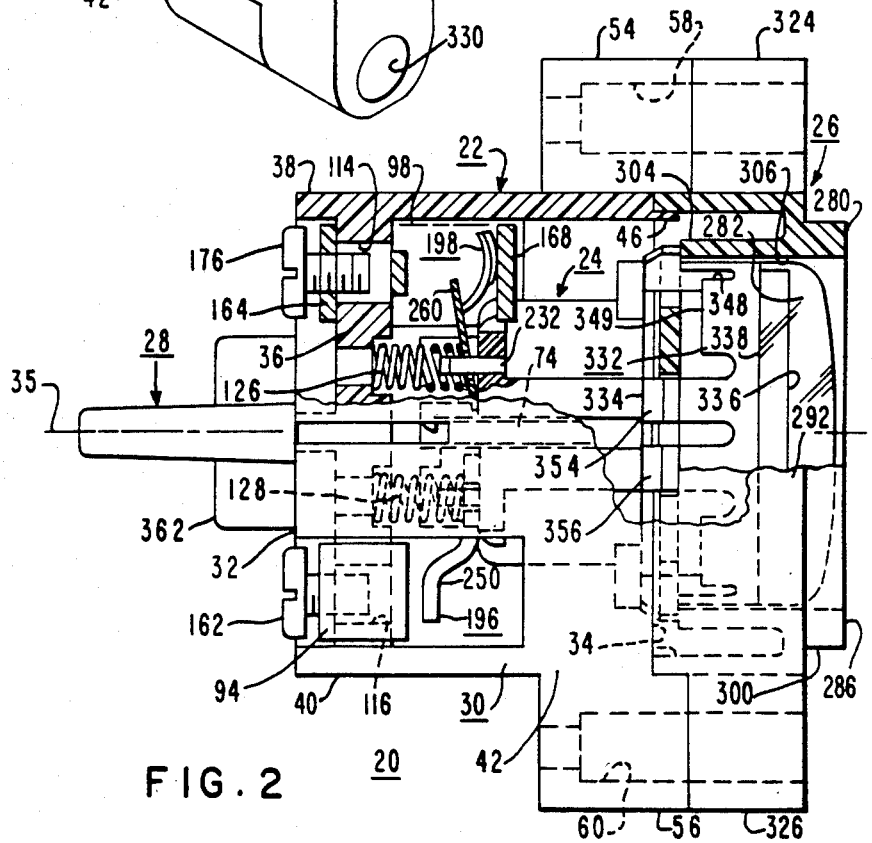
FIG. 2 is a side elevational view, partially in section, of the push button electrical switch assembly shown in FIG. 1.
Figure 3:
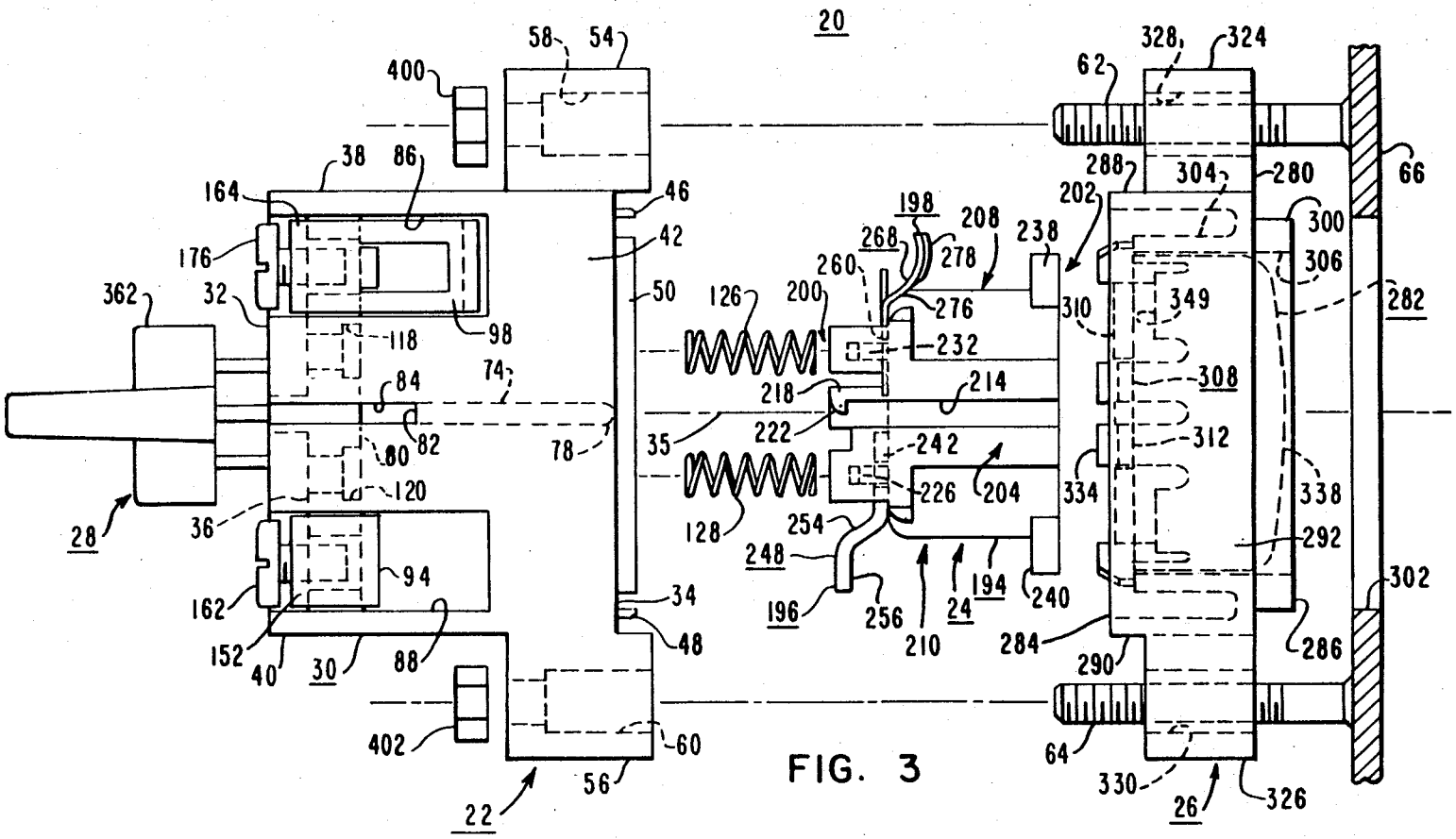
FIG. 3 is an exploded, side elevational view of the push button electrical switch assembly shown in FIGS. 1 and 2, illustrating housing, contact carrier, cover and lamp modules or subassemblies which are constructed according to the teachings of the invention.

Referring now to the drawings, and to FIGS. 1, 2 and 3 in particular, there is shown a new and improved push button electrical switch assembly 20 constructed according to the teachings of the invention. FIGS. 1 and 2 are perspective and side elevational views, respectively, of assembly 20, and FIG. 3 is an exploded view of the view shown in FIG. 2. FIG. 3 also illustrates an exemplary panel mounting arrangement for push button assembly 20. Push button assembly 20 is constructed of a plurality of subassemblies or modules which are easily assembled, and easily replaced during servicing. The modules, best shown in FIG. 3, include a housing module 22, a contact carrier module 24, a cover module 26, and a lamp module 28. The modules will first be separately described, the assembly of the modules to complete a push button electrical switch unit 20 will be described, and then a description of the operation of the assembly will be set forth.

Figure 5:
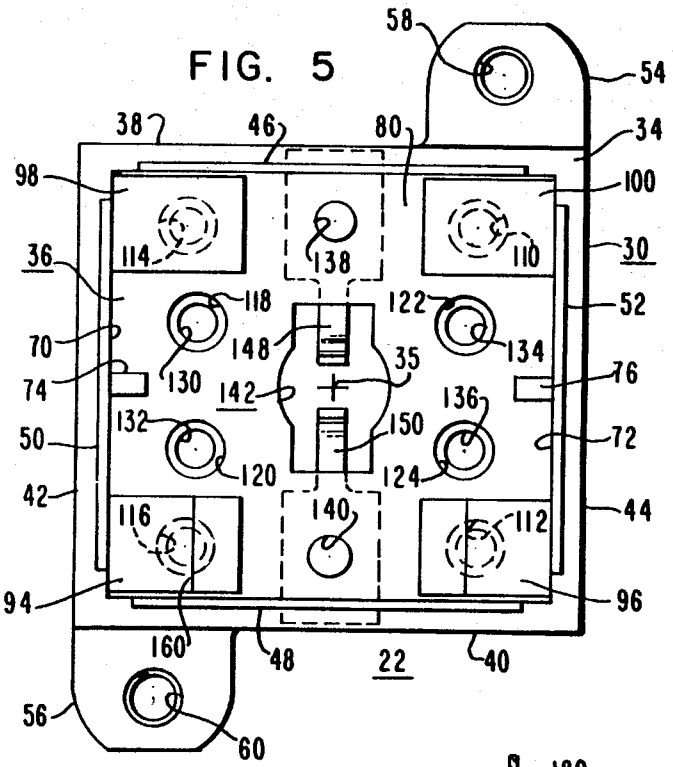
FIG. 5 is a front elevational view of the housing module shown in FIGS. 3 and 4.
Figure 8:
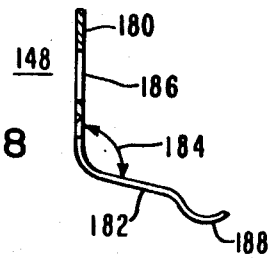
FIG. 8 is a side view of a lamp engaging contact, which contact is part of the housing module shown in FIGS. 3, 4 and 5.
Figure 6:
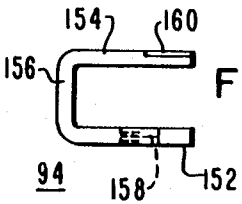
FIG. 6 is a side view of a stationary contact used for a N.O. application, which contact is part of the housing module shown in FIGS. 3, 4 and 5.
Figure 7:
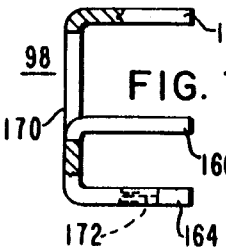
FIG. 7 is a side view of a stationary contact used for a N.C. application, which contact is part of the housing module shown in FIGS. 3, 4 and 5.
Figure 9:
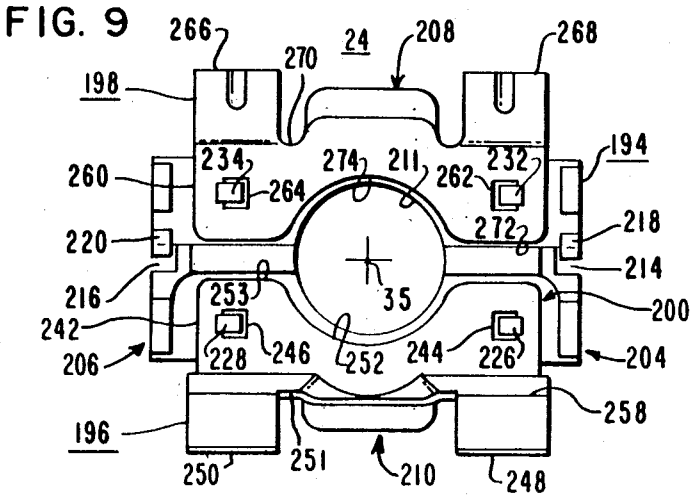
FIG. 9 is a rear elevational view of the contact carrier module shown in FIG. 3.

More specifically, housing module 22 will be described using FIGS. 2–8, with FIGS. 4 and 5 being rear and front elevational views, respectively, of housing module 22, and FIGS. 6, 7 and 9 illustrating side views of certain electrical contacts carried by the housing module. Housing module 22 includes an insulative switch base or housing portion 30. Base 30 is constructed of an extra strong, high impact plastic, such as a polycarbonate. As will be hereinafter explained, certain portions of base 30 must permit free and easy sliding action of the contact carrier module 24. Thus, in a preferred embodiment of the invention, base 30 is constructed of a polycarbonate having an additive, such as polyethylene, selected to provide the desired "slippery" surface, as well as adding to the elasticity of the resulting structure. For easy inspection of internal components, base 30 is preferably formed of a clear or translucent plastic.

Base or housing 30 is essentially a hollow structure having first and second axial ends 32 and 34, respectively, relative to a longitudinal axis 35. A wall portion 36 substantially closes the first axial end 32, and sidewall portions, such as top, bottom and first and second wall portions 38, 40, 42 and 44, are arranged to define an open second axial end, which end provides access to the housing cavity. The free forward edges of the sidewall portions 38, 40, 42 and 44, i.e., the second axial end of base 30, include projections for snap engagement with the cover module 26, such as projections 46, 48, 50 and 52, respectively. The top and bottom wall portions 38 and 40 include projections 54 and 56, respectively, having openings 58 and 60, respectively. Openings 58 and 60 are sized to receive studs or screws for mounting the push button assembly 30 on a panel, such as studs 62 and 64 shown fixed to a panel 66 in FIG. 3.

The inside surfaces 70 and 72 of the first and second sidewall portions 42 and 44, respectively, best shown in FIG. 5, include ribs, guide rails or tongue portions 74 and 76 which start with a rounded end, such as end 78 on tongue 74, and they extend perpendicularly toward wall portion 36. Before reaching the inner surface 80 of wall portion 36, they terminate with a flat end, such as flat end 82 shown on tongue 74. The sidewall portions 42 and 44 are slotted, starting at the flat ends of the tongues and extending to surface 80 of wall portion 36, such as slot 84 shown in sidewall portion 42.

Each of the sidewall portions 42 and 46 include first and second additional slots, such as slots 86 and 88, respectively, in sidewall 42, and similar slots 90 and 92 in sidewall 44. These slots start at the first axial end 32 and extend for a predetermined dimension towards the second axial end 34. The function of these slots is to provide access to an edge of wall portion 36 for receiving fixed electrical contacts. The dimensions of slots 86, 88, 90 and 92 are thus selected according to the dimensions of the fixed contacts.

Push button electrical switch assembly 20 provides the option of having two N.O. contacts, 2 N.C. contacts, or one of each. For purposes of example, one of each is shown in the drawings, with slots 88 and 92 receiving fixed contacts 94 and 96, respectively, of the N.O. type, and with slots 86 and 90 receiving fixed contacts 98 and 100, respectively, of the N.C. type. The outer surface of wall portion 36 may be recessed adjacent to each slot, such as recesses 102, 104, 106 and 108 adjacent to slots 86, 88, 90 and 92, respectively, with the recesses providing sidewalls for locating and aligning the fixed contacts, and insulative barriers between the contacts. Each recess includes an opening which extends through wall portion 36, such as openings 110, 112, 114 and 116 located in recessed portions 102, 104, 106 and 108, respectively.

Four additional openings 118, 120, 122 and 124 are provided in wall portion 36, which start at surface 80 and extend inwardly for a predetermined dimension. These openings function as spring seats for four helical compression springs, such as compression springs 126 and 128 shown in FIG. 3. Two additional helical compression springs are directly behind springs 126 and 128 in the view of FIG. 3. Smaller openings 130, 132, 134 and 136 may extend from the end of openings 118, 120, 122 and 124, respectively, to the outer surface of wall 36, for the purpose of receiving pins of an assembly fixture (not shown). These pins hold the compression springs properly aligned within their spring seats, while the housing and contact carrier modules 22 and 24, respectively, are assembled.

First and second tapped openings 138 and 140 and a central opening 142 are provided through wall 36, if the push button electrical switch assembly 20 is to be illuminable. Tapped openings 138 and 140 receive screws 144 and 146, respectively, which function to hold lamp engaging contacts 148 and 150, respectively, as well as to hold electrical wires which provide a lamp voltage. Central opening 142 has first and second rectangularly shaped ends 143 and 145, respectively, and a curved or rounded intermediate portion 147.

FIG. 6 is a side elevational view of a contact suitable for use as an N.O. fixed contact, such as contact 94. It includes first and second spaced leg portions 152 and 154, respectively, and a connecting bight portion 156. Leg portion 152 has a tapped opening 158 for receiving a screw. Leg portions 152 and 154 are spaced by a predetermined dimension selected to provide a snug, friction fit with the recessed wall portion 36 at recess 104. Contact 94 is formed of 0.050 inch thick copper having a 0.005 inch thick silver inlay 160 on the surface of leg portion 154 which will contact the movable contact of the combination.

Contact 94 is pushed onto the edge of wall portion 36, at recess 104, with the tapped opening in leg portion 158 being adjacent to the outer wall surface of the recess 104, and aligned with opening 116. A screw 16 is threadably engaged with the tapped opening 158. Screw 162 is selected to be long enough to enter opening 116, even when partially unscrewed to secure an electrical wire, in order to insure that the contact will not move from the assembled position. Fixed contact 96, which will be electrically connected to contact 94 via a bridging contact of the contact carrier module 24, is similar to contact 94, and need not be described in detail. Its elements are identified with the same reference numerals are contact 94, with the addition of a prime mark.

FIG. 7 is a side elevational view of a contact suitable for use as an N.C. fixed contact, such as contact 98. It includes first, second and third spaced leg portions 164, 166 and 168, respectively, and a connecting bight portion 170. Leg portion 164 has a tapped opening 172 for receiving a screw. Leg portions 164 and 166 are spaced to provide a snug, friction fit with recessed wall portion 36 at recess 102. It is formed of 0.050 inch thick copper, silver plated to 0.0005 to 0.001 inch.

Contact 98 is pressed onto the edge of wall portion 136 at recess 102, with the tapped opening 172 in leg portion 164 adjacent to the outer wall of the surface of recess 102, and aligned with opening 114. A screw 176 is threadably engaged with the tapped opening 172. Screw 176 enters opening 114 to prevent the contact from moving from the assembled position, and the screw also serves to secure an electrical wire. Fixed contact 100, which will be connected to contact 98 via a bridging contact of the contact carrier module 24 is similar to contact 98, with like reference numerals, except for a prime mark, being used to identify the elements of fixed contact 100.

FIG. 8 is a side elevational view of a contact suitable for use as a lamp engaging contact, such as lamp engaging contact 148. It includes first and second leg portions 180 and 182, with the angle 184 between them being about 105°. Leg portion 180 includes an opening 186, and leg portion 182 has a curved portion 188 adjacent to its free end. The outer surface of curve 188 will contact a lamp strip terminal. Contact 148 may be formed of 0.018 inch thick beryllium copper, for example, selected to provide and maintain spring characteristics which assure a constant predetermined contact pressure when flexed by a lamp terminal.

Figure 4:
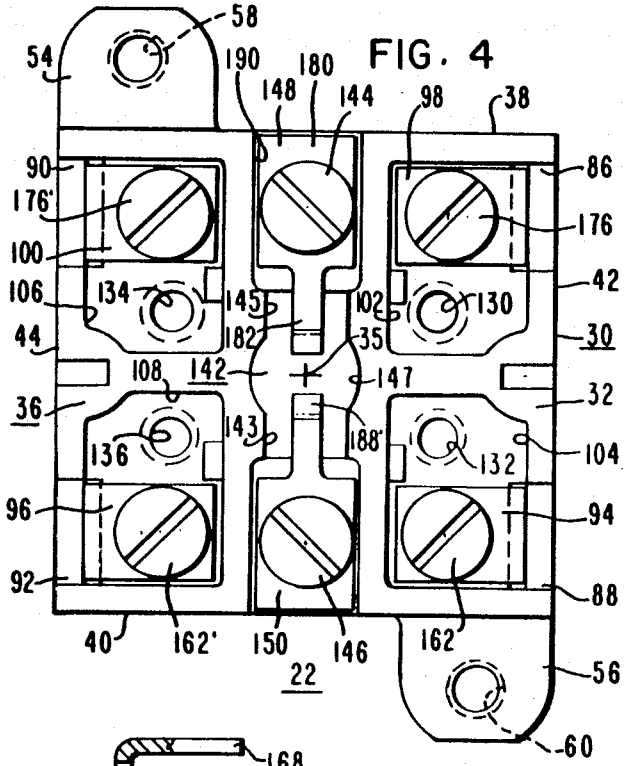
FIG. 4 is a rear elevational view of the housing module shown in FIG. 3.

As illustrated in FIG. 4, lamp engaging contact 148 has its first leg portion 180 fixed to the outer surface of wall portion 36 by screw 144, which surface may be recessed at 190 to provide sidewalls for contact alignment and electrical insulation. The second leg portion 182 extends into the housing cavity via central opening 142, adjacent its rectangular end 145. Curved portion 188 is spaced within the housing cavity from curved portion 188' of contact 150 by a predetermined dimension selected such that insertion of a lamp will flex each contact equally to provide the desired contact pressure.

Figure 11:
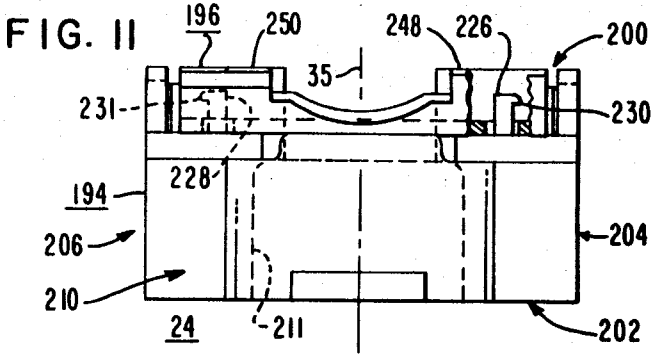
FIG. 11 is a side elevational view of the contact carrier module shown in FIGS. 3, 9 and 10.
Figure 10:
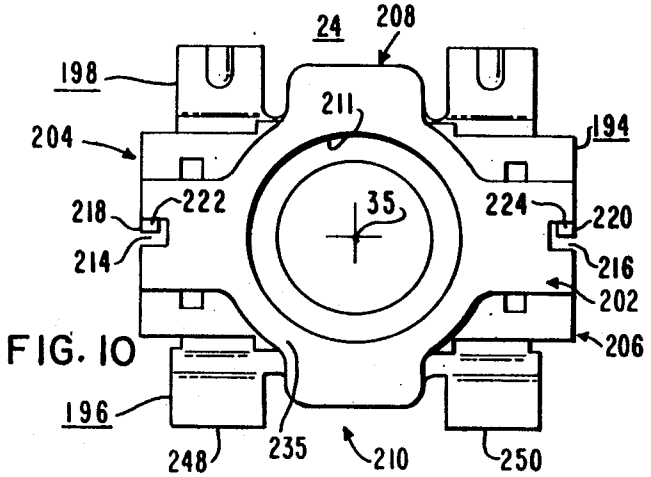
FIG. 10 is a front elevational view of the contact carrier module shown in FIGS. 3 and 9.

Contact carrier subassembly or module 24 includes an actuator 194 and first and second bridging contacts 196 and 198, respectively. Actuator 194 has first and second axial ends 200 and 202, respectively, first and second side guide edges 204 and 206, respectively, and top and bottom portions 208 and 210, respectively. A central longitudinal opening 211 extends between axial ends 200 and 202. FIGS. 2 and 3 illustrate an elevational view of side guide edges 204, FIG. 9 is an elevational view of the first axial end 200, FIG. 10 is an elevational view of the second axial end 202 and FIG. 11 is a view of bottom portion 210.

Actuator 194 is constructed of a plastic having characteristics which are similar to the plastic described relative to base 30, except instead of being transparent or translucent, it may be opaque. Side guide portions 204 and 206 include grooves 214 and 216, respectively, which extend between the axial ends 200 and 202. Grooves 214 and 216 have width and depth dimensions selected to smoothly cooperate with the tongues or guide rails 74 and 76, respectively, of base 30.

Yieldable or resiliently flexible leg members 218 and 220 are disposed on sides 204 and 206, respectively, at the ends of grooves 214 and 216, respectively. Leg members 218 and 220 include barb, catch or latch elements 222 and 224, respectively, on their free ends, which face and extend into the space aligned with their associated grooves, to partially block access thereto.

Axial end 200 of actuator 194 includes first and second resiliently yieldable or flexible leg members 226 and 228, respectively, which extend integrally outward from end 200 for holding contact 196. Leg members 226 and 228 have catch or latch elements at their free ends facing a side guide portion, such as latch elements 230 and 231 on legs 226 and 228, respectively, best shown in FIG. 11.

In like manner, axial end 200 includes first and second flexible leg members 232 and 234, which are similar to leg members 226 and 228, respectively, for holding bridging contact 198. The functions provided by leg members 226, 228, 232 and 234 will be more fully described when the bridging elements 196 and 198 are discussed in detail.

The second axial end 202 of actuator 194 has a flat surface 235 surrounding opening 211 against which pressure is applied by the push button portion of the cover module 26. Projections 238 and 240 from top and bottom portions 208 and 210, respectively, adjacent to the second axial end 202, in addition to providing an extended surface for the pressure points, enable the contact carrier module 24 to be easily removed from its assembled position in base 30.

A bridging contact 196 suitable for cooperating with and bridging fixed contacts 94 and 96 in a N.O. arrangement is shown in FIGS. 2, 3, 9, 10 and 11. FIGS. 2 and 3 illustrate an end view of contact 196, FIG. 9 illustrates a first major surface of contact 196 which faces the fixed contacts, FIG. 10 is a view which illustrates the side of contact 196 which is opposite to the first major surface shown in FIG. 9, and FIG. 11 is an edge view of contact 196, on the contact finger side thereof. Contact 196, for example, may be formed from 0.050 inch thick rigid copper having a 0.005 inch thick silver inlay located such that it will provide the contact surfaces which will engage the fixed contacts. Thinner, more flexible materials may be used if desired, without deleteriously affecting the operation of the N.O. contact. For example, a silver clad 0.010 inch thick phosphor bronze may be used.

Contact 196 includes a flat mounting portion 242 having first and second spaced openings 244 and 246 located and dimensioned to receive leg members 226 and 228, respectively. Contact 196 is snap engageable with actuator 194 via the cooperative leg members 226 and 228 and openings 244 and 246. Contact 196 is loosely held by leg members 226 and 228, to permit it to rock or pivot when it engages the fixed contacts, as will be hereinafter described. This result is provided by the predetermined spacing, best shown in FIG. 11, between the latch elements 230 and 231 of the leg members 226 and 228, respectively, and the surface of the flat mounting portion 242 of contact 196 which faces the latch elements after contact 196 is snapped into position on the leg members.

Contact 196 further includes first and second spaced contact fingers 248 and 250 which extend integrally outward from an edge 251 of mounting portion 242. The opposite edge 253 of mounting portion 242 includes a curved section 252 selected to conform to the size of opening 211 at the first axial end 200 of actuator 194.

Each contact finger, such as finger 250 shown in FIG. 3, proceeds from edge 251 of mounting portion 242 via a curved section 254 which joins a flat portion 256. Flat portion 256 proceeds to the free end. The surfaces of flat portion 256 are substantially parallel with the surfaces of flat mounting portion 252. The silver inlay, such as inlay 258 on contact finger 248, starts near the extreme end and it covers the surface of the flat portion, as well as a portion of the curved surface, as best shown in FIG. 9.

Figure 12:
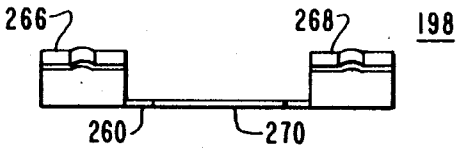
FIG. 12 is a side view of a movable contact used for a N.C. application, which movable contact is part of the contact carrier module shown in FIGS. 3, 9, 10 and 11.

A bridging contact 198 suitable for cooperating with and bridging fixed contacts 98 and 100 in a N.C. arrangement is shown in FIGS. 2, 3, 9, 10 and 12. FIGS. 2 and 3 illustrate an end view of contact 198, FIG. 10 illustrates the surface which faces the contact engaging surface 174 of the fixed contacts, FIG. 9 is a view of the side opposite to the side shown in FIG. 10, and FIG. 12 is an edge view of the contact finger sides. Contact 198, for example, may be formed of 0.010 thick phosphor bronze, silver plated 0.0005 to 0.001 inch thick, which will provide the equalization of the N.C. contact required to assure good electrical contact, and good contact wiping action.

Contact 198 includes a flat mounting portion 260 having first and second spaced openings 262 and 264 located and dimensioned to receive leg members 232 and 234, respectively. Contact 198 is snap engageable with leg members 232 and 234 via its openings. Similar to contact 196, contact 198 is loosely held by leg members 232 and 234 to permit to to rock or pivot when it engages the fixed contacts.

Contact 198 further includes first and second spaced contact fingers 266 and 268 which extend integrally outward from an edge 270 of mounting portion 260. The opposite edge 272 of mounting portion 260 includes a curved section 274 which conforms with the size of opening 211 at the first axial end 200 of actuator 194.

Each contact finger, such as finger 268, proceeds from edge 270 via a curved section 276 which joins a flat portion 278. Flat portion 278 extends to the free end. The surfaces of flat portion 278 are substantially parallel with the surfaces of flat mounting portion 260.

Figure 13:
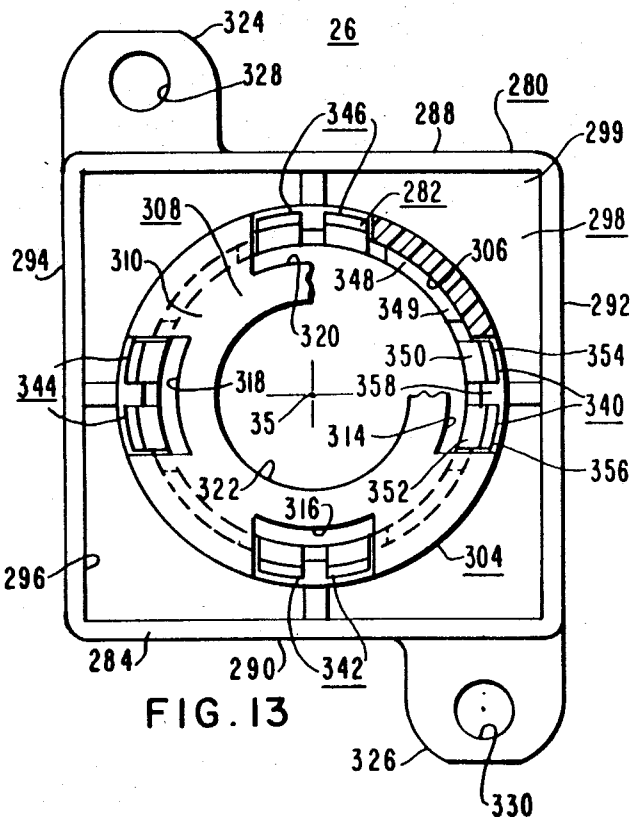
FIG. 13 is a rear view of the housing module shown in FIG. 3.

Cover module 26 is shown in FIGS. 1, 2, 3 and 13, with FIG. 1 being a perspective view of the front portion, FIGS. 2 and 3 being side elevational views, and FIG. 13 being an elevational view of the rear. Cover module 26 includes a halo 280 and a push button 282. Halo 280 is constructed of the same high strength, impact-resistant plastic as the base 30. The plastic may be translucent, or opaque, as desired. Halo 280 includes first and second axial ends 284 and 286, respectively, and its cross-sectional configuration is square, bounded by top, bottom, and first and second side portions 288, 290, 292 and 294, respectively. Halo 280 is open at its first axial end 284, with the top, bottom and side portions having a predetermined thickness dimension sized to provide a substantially square opening 296 which is complementary with the projections 46, 48, 50 and 52 located on the second axial end of base 30. These projections extend into opening 296 when the housing and cover modules are assembled, i.e., they are snap engageable, to frictionally hold the housing and cover modules in assembled relation.

The second axial end 286 is partially closed by a wall portion 298 having inner and outer surfaces 299 and 301, respectively. Wall portion 298 extends inwardly from the outer edge defined by the top, bottom and side portions, until reaching a circular projection 300. Projection 300 extends axially outward from the outer surface 301 of wall portion 298. For example, projection 300 may extend into a complementary opening 302 in the panel 66 shown in FIG. 3. Projection 300 also surrounds and protects button 282, with the projection 300 extending axially outward beyond the outwardly biased position of button 282.

A tubular, cylindrical member 304 extends into the cavity of halo 280 from inner surface 299 of wall portion 298. Member 304 includes an inside surface 306 which starts at the free end of projection 300, and it extends axially inward to a wall portion 308. Wall portion 308 has first and second surfaces 310 and 312, respectively. Inside surface 306 defines a diameter which is complementary to the O.D. of the button 282. The first surface 310, which is located within the cavity defined by the halo 280, is about 0.030 inch from the edge which defines the first axial end 284.

Wall portion 308 has four perimetrically spaced slots or openings 314, 316, 318 and 320, and a central opening 322. Slots 314, 316, 318 and 320 enable the button 282 to contact the actuator 194 of the contact carrier module 24. Opening 322 enables light from the lamp module 28 to illuminate the push button 282.

Halo 280 is completed by projections 324 and 326 on the top and bottom portions 288 and 290, respectively. Projections 324 and 326 have openings 328 and 330, respectively, which align with openings 58 and 60 of projections 54 and 56 of base 30, when the cover and base modules are snapped together.

Button 282 includes a cylindrical base portion 332 having first and second axial ends 334 and 336, respectively, and a crystal 338 which is attached to the second axial end 336 of the base portion 332, such as by ultrasonic welding. Base 332 and crystal 338 are both formed of a high strength polycarbonate, similar to the other plastic elements of the push button switch assembly 20. The base may be translucent, or opaque, as desired. The crystal is transparent. The first axial end 334 is open, and the second axial end 336 is closed by a wall portion upon which suitable numbers or letters may be placed before the crystal 338 is attached.

Base portion 332 is slotted, starting at its first axial end, with a plurality of circumferentially spaced slots defining first, second, third and fourth evenly spaced pairs 340, 342, 344 and 346 of legs. A wider, but shorter leg is provided by the circumferentially spaced slots between each pair of legs, such as leg 348 located between leg pairs 340 and 346. The intermediate, shorter legs, such as leg 348, are terminated with a flat surface 349 which establishes a limit on the axial movement of button 282 towards the first axial end of halo 280, i.e., it contacts surface 312 of wall portion 308. The legs of each pair of legs, such as the legs 350 and 352 of pair 340, include latch elements 354 and 356, respectively, which extend radially outward from the free ends of the legs. The "hook" surfaces of the latch elements 354 and 356 provide the limit on axial movement of button 282 towards the second axial end 286 of halo 280, as the surfaces of the latch element which face end 286, and which are perpendicular to the longitudinal axis 35, strike a surface of the cylindrical wall portion 304 which is exposed by the spaced slots, such as surface 358 associated with slot 314. The latch elements 354 and 356 of the various pairs of legs interfere with the inner surface 306 when the button 282 is assembled with halo 280. Button 282 is assembled with halo 280 by advancing it axially into the opening defined by surface 306. The plurality of legs contact surface 306, and they flex inwardly until reaching a complementary slot. Once the latch elements of the legs reach a slot, the legs snap outwardly into a slot, and the button 282 is held captive to the halo 280, while being free to move axially between the axial limits hereinbefore described.

Figure 14:
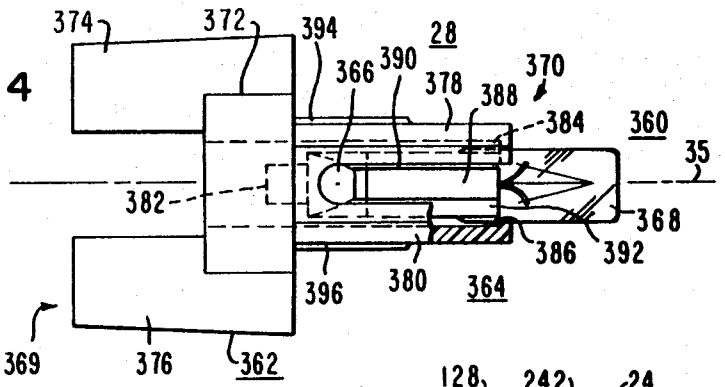
FIG. 14 is a side elevational view of the lamp module shown in FIG. 3.

The lamp module 28 is shown in FIGS. 2, 3 and 14. It includes a lamp 360 and a lamp holder 362. Lamp 360 is of the type which includes first and second flat, elongated contact strips or terminals circumferentially spaced on opposite sides of an insulating base and glass envelope, such as contact strip 364 on one side of an insulating base 366, and a glass envelope 368. Lamp 360, for example, may be type 6PSB through type 120PSB. A contact strip similar to contact strip 364 is disposed on the opposite side of base 366.

Lamp holder 362, which is constructed of the same high strength plastic material as the other plastic elements of the push button switch assembly 20, has first and second axial ends 369 and 370, respectively. A tubular base 372 supports first and second integral projections or ears 374 and 376 which extend to the first axial end 369, with the ears 374 and 376 functioning as handles to permit the lamp holder 362 to be easily grasped for insertion into, and removal from, the base or housing module 22.

Tubular base 372 further includes first and second spaced fingers 378 and 380, respectively, which extend outwardly to the second axial end 370, and a transverse stop member 382 which limits how far lamp 360 can be inserted into the lamp holder 362. The fingers 378 and 380 are spaced to expose the lamp contact strips, such as lamp contact strip 364, and they include lips 384 and 386, respectively, which snap over the forward edges of the lamp contact strips when the lamp 360 is correctly positioned in the lamp holder 362. In other words, the fingers 378 and 380 are spaced such that insertion of the lamp 360 causes them to flex outwardly, and then to snap back and secure the lamp 360 in the lamp holder via the stop 382 and lips 384 and 386. Each lamp contact strip 364 has three integral flat surfaces, arranged to partially surround the base and glass envelope, including a central surface 388 and first and second lateral surfaces 390 and 392. The fingers 378 and 380 each apply pressure to a lateral surface of each contact strip, to correctly orient the lamp 360 about the longitudinal axis 35.

First and second ribs 394 and 396 extend outwardly from the tubular base 372 for a predetermined dimension on each of the fingers, with the ribs being dimensioned to provide a slight interference fit with the curved sides 147 of opening 142 in base 30. This frictional engagement securely holds the lamp module 28 in the base 30, it presses the fingers tightly together to securely hold the lamp 360, and it allows the lamp module to be quickly removed for re-lamping, when necessary. The sides of fingers 378 and 380 are complementary to the curved sides 147 of opening 142 in base 30, allowing the lamp module to only be inserted into the base 30 with an orientation which causes the lamp engaging contacts 148 and 150 to flexibly contact the lamp's contact strips.

In the assembly of the push button switch assembly 20, the fixed contacts 94, 96, 98 and 100 are selected according to the switch functions to be performed, i.e., both N.O., both N.C., or one of each, and they are pushed into position on the base 30 and secured with screws 162, 162', 176 and 176', respectively. In like manner, lamp engaging contacts 140 and 150 are placed into position on base 30 and secured with screws 144 and 146, respectively.

The four helical springs, such as springs 126 and 128, are each positioned with one axial end disposed in a spring seat formed in base 30. For example, the base 30 may be placed in a fixture (not shown) having four upstanding pins located to extend into the base cavity via openings 130, 132, 134 and 136. The four springs may simply be telescoped over the pins of the fixture.

The movable bridging contacts are selected for the switch contact function to be performed, i.e., both N.O., both N.C., or one of each, such as contacts 156 and 158. They are snapped into position over the flexible legs located on the first axial end 200 of actuator 194, and the resulting contact carrier subassembly or module 24 is complete. Module 24 is oriented at the second axial end 34 of base 30 such that the grooves 214 and 216 are aligned with the tongues 74 and 76, respectively, with the interfering flexible legs 218 and 220 contacting the rounded ends 78 of the tongues. Axial pressure is then applied to the contact carrier module 24 to cause the legs 218 and 220 to resiliently flex out of the way and allow the contact carrier 24 to be advanced into the housing cavity. When the slots 84 are reached, legs 218 and 220 snap back into their unbiased positions, and the contact carrier module is correctly assembled with the housing module 22. When the contact carrier module 24 is to be removed from its operative position within the housing cavity for service, a screw driver may be inserted under each projection 238 and 240 of actuator 196. A slight tipping or lever action of each screw driver will release the contact carrier module 24 from its operative position, allowing it to be removed from the cavity of the housing module 22.

The housing module 22 is removed from the spring-aligning fixture when the contact carrier module contacts the alignment pins and the legs 218, 220, 226 and 228 enter the free ends of the helical springs. In other words, the heretofore free ends of the four helical springs encircle the legs which hold the bridging terminals, and thus these flexible legs additionally function as spring bosses. The four helical springs now directly contact the bridging contacts 196 and 198 and bias their mounting portions 242 and 260 flat against the supporting base provided by the actuator 194. While two springs contact each bridging contact, the other ends of the springs are supported by the insulative spring seats, and thus the helical springs carry no current and cannot lose their resiliency due to heat, as there are no $I^2R$ losses in the springs.

The four springs bias the contact carrier module 224 outwardly, with the latch elements 222 and 224 contacting a flat end of the tongues 74 and 76, respectively, to limit the movement, such as latch element 222 contacting flat end 82 of tongue 74.

A halo 280 and button 282 are then selected according to the desired special effect, i.e., the desired combination of translucent and opaque halo and button is selected, in the desired colors. For example, both may be opaque in an unlighted button. In a lighted button, both the halo and push button may be translucent, or one may be opaque and the other translucent, as desired. The button 282 is snapped into the halo 280, and the resulting cover module 26 is snap-engaged with the housing module 22. The ends 334 of the legs on button 282 extend past the first axial end 284 of halo 280, as shown in FIG. 3, axially moving the contact carrier module 24 slightly against the spring bias, which also biases the push button 282 axially outward within the halo 280, until surfaces 354 and 356 of each pair of legs contact surface 358 of the associated slot. Thus, the latch elements 222 and 224 of the resilient legs 218 and 220 are biased slightly away from the flat ends of the associated tongues 74 and 76. The lamp module 28 may be inserted into the back of the housing module 22, via opening 142 of base 30, if the assembly is of the illuminated type.

The push button switch assembly 20 is thus completely assembled and ready to be inserted into a panelboard, such as by inserting screws or studs 62 and 64, shown in FIG. 3, through the aligned mounting openings of the housing and cover modules. This will automatically position projection 300 within opening 302 of the panel. Nuts 400 and 402 are then threadably engaged with screws 62 and 64, respectively, which clamp the housing and cover modules tightly together. Electrical wires are then attached to the various contacts via their associated screws. It will be noted that the lamp module 28 may be inserted, or removed, notwithstanding the mounting of the push button assembly in a panelboard, and the wiring thereof.

External axial pressure on the crystal 338 of push button 282 advances the contact carrier module 24 rectilinearly, regardless of where the pressure is applied to the crystal face, because of the guide rail function provided by the long tongue-and-groove arrangements. The contact carrier module 24 moves freely without binding in the housing module 22 when the button 282 is depressed, because of the slippery, low friction surfaces of the mating, relatively movable parts of the push button assembly 20.

Any excess pressure on push button 282 is easily absorbed by assembly 20, as the pressure is uniformly distributed throughout the mechanical structure of the push button switch assembly 20. A limit to axial movement in the button-depressed direction is cooperatively provided by the base 30 and actuator 194, and by the button 282 and halo 280. The surfaces which define the first axial end 200 of actuator 194 contact flat surface 80 of wall 36, and simultaneously the flat ends 349 of the four circumferentially spaced short legs, such as leg 348, contact surface 312 of wall portion 308 of halo 280.

Figure 15:
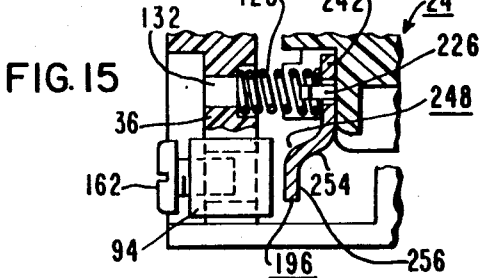
FIGS. 15, 16 and 17 are fragmentary views of a N.O. contact closing, which illustrate the rocking or pivoting action of the movable contact which produces a contact wiping action.
Figure 17:
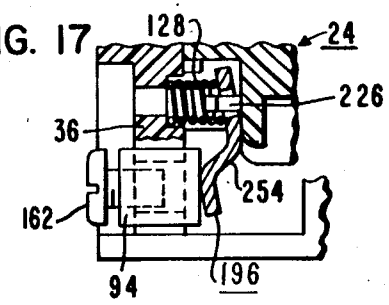
Figure 16:
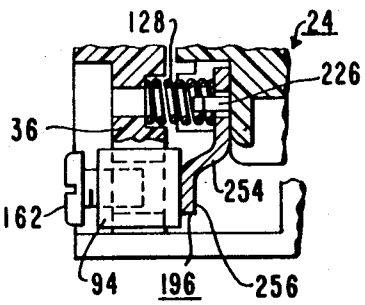

When a movable bridging contact makes contact with the mating fixed contacts of the housing module 22, the bridging contact rocks or pivots against the bias of the two helical springs in contact therewith, to provide a positive wiping action which maintains the mating contact surfaces free of oxide and dirt, assuring good electrical and mechanical contact for even low voltage and/or low current applications. FIGS. 15, 16 and 17 illustrate the contact wiping action sequentially as the N.O. contacts, provided by the fixed contacts 94 and 96, and bridging contact 196, are closed. FIG. 15 illustrates the contacts prior to actuation, and FIG. 16 illustrates the contacts when they initially touch. There is no rocking or pivoting at the initial contact closure point illustrated in FIG. 16, showing how the flat portion 250 of the bridging contact makes the initial contact with the surfaces of the fixed contact. Then, as the push button 282 further depresses the actuator 194, the bridging contact 196 rocks or pivots on its forward edge 251 against the bias of spring 128 and a similar spring on the other side of the bridging contact. The bias provided by the springs on the bridging contact up to this point had been completely axial. The pivoting of the bridging contact now bends one side of the two springs, and the springs now provide a lateral bias which attempts to pivot the bridging contact back to its original position. It will be noted from FIG. 17 that the surface of the bridging contact slides across the surface from its flat portion 256 to its curved section 254, providing a highly effective and repeatable wiping action on closure. When the button is released, a reverse wiping action occurs.

FIG. 2 illustrates that the same wiping action occurs when the external force on button 282 is released, and the N.C. contacts close. The initial contact is made with spring 126 and its counterpart providing axial bias on the bridging contact 198. As the actuator 194 continues to move outwardly, a lateral bias is provided by the pair of helical springs, as the bridging contact 198 rocks back, or pivots on its rear edges 272, and it slides its contact surface from its flat portion 278 to its curved section 276. When the button 282 is depressed again, the N.C. contacts open with a wiping action, in reverse, from the curve to the flat portion thereof, to again wipe the contact surfaces.

I claim as my invention:

1. A push button electrical switch assembly, comprising:

a housing including a first electrical contact, a contact carrier including an actuator having a second electrical contact, means mounting said actuator within said housing for movement between first and second axial limits, with at least one of said limits being a contact engaging position, biasing means urging said actuator towards its second axial limit, a cover, and a push button mounted in said cover for movement between first and second axial limits, said cover being disposed on said housing, with the biased actuator urging the push button to its second axial limit, said first electrical contact including at least first and second spaced contact members, said second electrical contact including at least one metallic bridging member for engaging said at least two fixed contact members, said bridging contact member being held in a first position by said biasing means, and pivoting upon engagement with said at least two fixed contact members, against the bias of said biasing means, to a second position, to provide a contact-wiping engagement, said housing including first and second spaced spring seats, said bridging member having first and second spaced contact fingers, and first and second spaced openings, said biasing means including first and second compression springs having first and second ends, with their first ends being disposed in said first and second spaced spring seats, respectively, said contact carrier including first and second resilient leg elements with said first and second resilient leg elements snapping into the first and second openings, respectively, of the bridging member, and into the second ends respectively, of the first and second compression springs, to provide the functions of securing the bridging contact to the contact carrier while defining a predetermined fixed range of pivotable movement, and also functioning as spring bosses for the first and second compression springs.

2. A push button electrical switch assembly, comprising:

a housing including a first electrical contact, a contact carrier including an actuator having a second electrical contact, means mounting said actuator within said housing for movement between first and second axial limits, with at least one of said limits being a contact engaging position, biasing means urging said actuator towards its second axial limit, a cover, and a push button mounted in said cover for movement between first and second axial limits, said cover being disposed on said housing, with the biased actuator urging the push button to its second axial limit, said first electrical contact including at least first and second spaced contact members, said second electrical contact including at least one metallic bridging member for engaging said at least two fixed contact members, said bridging contact member being held in a first position by said biasing means, and pivoting upon engagement with said at least two fixed contact members, against the bias of said biasing means, to a second position, to provide a contact-wiping engagement, said housing and actuator each including first and second opposite sides, said means which mounts the actuator in the housing including first and second cooperative tongue-and-groove arrangements disposed on the first and second opposite sides of the housing and actuator, including first and second tongues integral with the housing and first and second grooves disposed in the actuator, and first and second slots in the first and second opposite sides, respectively, of the housing, adjacent to an end of the first and second tongues, respectively, said contact carrier including first and second resilient legs each having a free end, and a locking barb at the free end, said locking barb being arranged to contact a tongue and bias its associated resilient leg during assembly of the contact carrier with the housing, and to snap into a slot, with the locking barb contacting an end of the associated tongue to limit axial movement of the contact carrier in one direction, and with the first end of the contact carrier contacting the inner surface of the wall portion which defines the substantially closed first end of the housing, to limit axial movement of the contact carrier in the other direction.

3. The push button assembly of claim 2 wherein the push button biases the first and second resilient legs of the actuator away from its second axial limit when the cover is assembled with the housing, to provide a bias which urges the push button to its second axial limit.

4. A push button electrical switch assembly, comprising:

a housing including a first electrical contact, a contact carrier including an actuator having a second electrical contact, means mounting said actuator within said housing for movement between first and second axial limits, with at least one of said limits being a contact engaging position, biasing means urging said actuator towards its second axial limit, a cover, and a push button mounted in said cover for movement between first and second axial limits, said cover being disposed on said housing, with the biased actuator urging the push button to its second axial limit, said first electrical contact including at least first and second spaced contact members, said second electrical contact including at least one metallic bridging member for engaging said at least two fixed contact members, said bridging contact member being held in a first position by said biasing means, and pivoting upon engagement with said at least two fixed contact members, against the bias of said biasing means, to a second position, to provide a contact-wiping engagement, said push button having first and second axial ends, a base portion adjacent to its first axial end, a plurality of resilient first legs attached to said base portion having free ends which coincide with the first axial end of the push button, latching barbs extending radially outward from the free ends of said first legs, and a plurality of second legs attached to said base portion, said second legs having free ends which extend toward the first axial end of the push button, but which are shorter than the first legs, said cover including a tubular portion defining a circular wall having a cylindrical inner surface, said tubular portion having first and second axial ends, and a flat wall at its first axial end, said flat wall having openings for receiving the plurality of first legs of the push button, with said openings being immediately adjacent to said circular wall, to expose circumferentially spaced axial end portions of the circular wall, said first legs being biased by contact between the cylindrical inner surface of the tubular portion and said latching barbs during assembly, with the first legs snapping into the openings in the flat wall, said free ends of the second legs, and the flat wall of the tubular portion cooperatively defining the first axial limit of the push button within its cover, and said latching barbs on the first legs and the exposed axial end portions of the circular wall cooperatively defining the second axial limit of the push button within the cover.

5. A push button electrical switch assembly, comprising:

a housing including a first electrical contact, a contact carrier including an actuator having a second electrical contact, means mounting said actuator within said housing for movement between first and second axial limits, with at least one of said limits being a contact engaging position, biasing means urging said actuator towards its second axial limit, a cover, a push button mounted in said cover for movement between first and second axial limits, said cover being disposed on said housing, with the biased actuator urging the push button to its second axial limit, said first electrical contact including at least first and second spaced contact members, said second electrical contact including at least one metallic bridging member for engaging said at least two fixed contact members, said bridging contact member being held in a first position by said biasing means, and pivoting upon engagement with said at least two fixed contact members, against the bias of said biasing means, to a second position, to provide a contact-wiping engagement, said housing having first and second axial ends, and a wall portion which substantially closes the first end of the housing, said wall portion of the housing including inner and outer surfaces, and a central opening which extends between said surfaces, first and second lamp-engaging contacts having first and second integral leg portions, means attaching the first leg portion of each of the first and second lamp-engaging contacts to said second outer surface of the wall portion of the housing such that their second leg portions extend into the housing via the central opening, a lamp assembly including a lamp holder and lamp, said lamp holder having first and second spaced, resilient fingers, said lamp having first and second axially extending lateral contact strips, said lamp being disposed between the first and second spaced resilient fingers such that the first and second lateral contact strips of the lamp are accessible between the spaced fingers, said lamp assembly being releasably inserted into the central opening such that said lamp and a portion of the resilient fingers extend into said housing, with the second portions of the first and second lamp-engaging contacts being in electrical contact with the first and second lateral contact strips of the lamp within the housing, and first and second rib members integral with the lamp holder, positioned and dimensioned to frictionally engage the surface which defines the central opening of the housing, while stimultaneously forcing the spaced first and second resilient fingers together to increase their grip on said lamp when the lamp assembly is inserted into the central opening.

6. A push button electrical switch assembly, comprising:

a housing including a first electrical contact, a contact carrier including an actuator having a second electrical contact, means mounting said actuator within said housing for movement between first and second axial limits, with at least one of said limits being a contact engaging position, biasing means urging said actuator towards its second axial limit, a cover, and a push button mounted in said cover for movement between first and second axial limits, said cover being disposed on said housing, with the biased actuator urging the push button to its second axial limit, said first electrical contact including at least first and second spaced contact members, said second electrical contact including at least one metallic bridging member for engaging said at least two fixed contact members, said bridging contact member being held in a first position by said biasing means, and pivoting upon engagement with said at least two fixed contact members, against the bias of said biasing means, to a second position, to provide a contact-wiping engagement, said first electrical contact including first and second pairs of fixed electrical contacts, said second electrical contact including first and second pivotable bridging contacts for cooperating with the first and second pairs, respectively, of fixed contacts, said biasing means including first and second pairs of helical compression springs each having first and second ends, said first pair of compression springs contacting the first bridging contact, said second pair of compression springs contacting the second bridging contact, each of said helical compression springs being successively subjected to first and second compressions during contact closure, with the first compression being solely axial between its ends, and with the second compression including both axial compression between its ends and lateral compression adjacent to one end, with the lateral compression occurring when a bridging contact pivots to its second position.

7. A push button electrical switch assembly, comprising:

a hollow, insulative housing having a wall portion which defines a substantially closed first end, and an open second end, including spring seats and a first electrical contact fixed to its first end, an insulative actuator having first and second axial ends, contact mounting projections at its first axial end, and a second electrical contact disposed on the mounting projections, means mounting said actuator for rectilinear reciprocation within said housing, between first and second axial limits, a compression spring having first and second ends, with its first end disposed in a spring seat of the housing and its second end disposed about a mounting projection at the first axial end of the insulative actuator, against said second electrical contact, a cover including a push button having first and second axial ends disposed for rectilinear reciprocation between first and second axial limits, said cover being disposed to close the open second end of said housing, with the first end of the push button contacting the second end of said actuator to compress the compression spring and bias the push button to its second axial limit, said second electrical contact including a rigid metallic bridging member which is pivotable as a unit, within a predetermined fixed range, against the bias of said compression spring, when it contacts said first electrical contact at either reciprocation limit of the actuator, to provide a wiping action between the first and second electrical contacts.

* * * * *